United States Patent [19]

Dislich et al.

[11] Patent Number: 4,928,931

[45] Date of Patent: May 29, 1990

[54] METHOD FOR CONTROLLING DISCHARGE OF STEEL FROM A CASTING LADLE

[75] Inventors: Heinz Dislich, Am Botanischen Garten, 8, 4100 Duisburg; Horst Richter, Duisburg, both of Fed. Rep. of Germany

[73] Assignees: Heinz Dislich, Duisburg; Krupp Stahl, Bochum, both of Fed. Rep. of Germany

[21] Appl. No.: 247,112

[22] Filed: Sep. 20, 1988

Related U.S. Application Data

[62] Division of Ser. No. 735,957, May 20, 1985, abandoned.

[30] Foreign Application Priority Data

May 24, 1984 [DE] Fed. Rep. of Germany ..... 3419306

[51] Int. Cl.[5] ..... C21B 7/12

[52] U.S. Cl. ..... 266/45; 222/590; 222/600

[58] Field of Search ..... 266/45; 222/600, 590

[56] References Cited

U.S. PATENT DOCUMENTS 3,511,261 5/1970 Bick ..... 222/600

3,944,116 3/1976 Danieli ..... 266/45

*Primary Examiner*—Peter D. Rosenberg

*Attorney, Agent, or Firm*—Herbert Dubno; Andrew Wilford

[57] ABSTRACT

A spout-filling mass for casting ladles has a particulate filling mass for filling the pouring spout which consists essentially of 50 to 70% by weight of chromium ore sand, 0.03 to 0.2% by weight iron oxide and the balance quartz sand intimately mixed together.

6 Claims, 1 Drawing Sheet

METHOD FOR CONTROLLING DISCHARGE OF STEEL FROM A CASTING LADLE

This is a divisional of co-pending application Ser. No. 735,957 filed on May 20, 1985, now abandoned.

CROSS REFERENCE TO RELATED APPLICATION

This application is related to our-copending application Ser. No. 438,807 filed 3 Nov. 1982 U.S. Pat. No. 4,525,463.

FIELD OF THE INVENTION

Our present invention relates to a spout-filling mass for a slider-controlled outlet of a casting ladle in which a metal melt, generally steel, is received and which is adapted to form a cap over the spout by the interaction of the pulverulent mass with the steel melt, the cap breaking away upon movement of the slider into its open position and the discharge of the supporting mass.

BACKGROUND OF THE INVENTION

A casting ladle for a steel melt can comprise, as described in the aforementioned copending application and references of record in the file thereof, a spout or outlet through which the melt is to be discharged and generally in the form of an outlet sleeve, the lower end of which may be closed by, for example, a slider, valve plate or other plate-like closure.

As described in the aforementioned copending application, it is possible to separate the melt from the valve plate or slider by a flowable spout-filling mass of a refractory composition which prevents obstruction of the movement of the slider, readily is discharged from the spout when the slider is moved into its open position, but forms a cap or dome over the spout opening or sleeve by interaction of the steel melt with components of the spout-filling mass the cap being capable of preventing penetration of the melt into this mass and to the slider but being adapted to break away from the weight of the melt above this cap when the supporting mass is discharged in the open position of the slider.

The spout-filling mass can consist of chromium ore sand, i.e. a chromite sand rich in chromium oxide and especially $Cr_2O_3$, quartz sand (predominantly consisting of $SiO_2$) and a finely divided auxiliary substance which contributes to the cap formation by interaction with the melt.

The chromium ore component can make up less than 70% of the mixture and the auxiliary component is present in an amount by weight which is less than that of the chromium ore component and the quartz sand component.

The reference to the cap formation herein will be understood to signify that where the spout-filling mass comes into contact with the melt, i.e. at the interface between this mass and the melt, the spout-filling mass is sintered into a thin shell constituting the aforementioned cap which has a dome configuration able to withstand in part ferrostatic pressure of the melt as long as the spout remains filled with the comminuted but flowable portion of the mass, but which can rupture under the ferrostatic pressure when the slider is moved to its open position and the support of the mass below the cap is eliminated.

The proportions given herein are proportions by weight unless stated otherwise.

In the aforementioned copending application corresponding to German patent No. 32 14 168, a spout-filling mass is described which has been found to be highly effective in bringing about the cap formation as indicated above but which nevertheless allows a practically unlimited slider opening rate in the sense that discharge of the ladle with movement of the slider is not materially prevented, i.e. is 100%.

Apparently the cap formation is a result of a reduction of part of the chromium ore component with the carbon in this spout-filling mass at the interface thereof with the melt.

Care must be taken, of course, in such a system to ensure that excessive reduction of the chromium ore component does not occur and hence the chromium ore and carbon proportions must be designed for the particular purposes and indeed are especially established for various melts and ladle applications.

In general the carbon component should be about 3 to 10% of the spout-filling mass.

The presence of carbon in the spout-filling mass, however, can contribute to some carburization of the steel melt which is sometimes disadvantageous. Furthermore, when the carbon is in the mass in the form of a hydrocarbon, hydrogen is cracked from the carbon-containing component and can diffuse into the steel melt. This is detrimental especially to vacuum treated steels and can give rise to flocculation therein.

OBJECTS OF THE INVENTION

It is the principal object of the present invention to improve upon our earlier system as described in the aforementioned copending application so that cap formation can occur as there described without the danger of carburization of the steel melt or release of hydrogen which may diffuse into the steel melt.

Another object of our invention is to provide an efficient spout-filling mass which allows rapid discharge of the melt and nevertheless is free from drawbacks of earlier techniques.

SUMMARY OF THE INVENTION

We have discovered that, quite surprisingly, the carbon or carbon-containing auxiliary agent of our earlier application can be replaced by a lesser quantity of finely divided iron oxide ($Fe_2O_3$) to allow the mass nevertheless to provide the desired cap without, however, any danger of the carburization of the melt or diffusion of hydrogen into the latter.

According to the invention, therefore, the spout-filling mass comprises 50% to 70% chromium ore sand (chromite component), 0.03 to 0.2% finely divided iron oxide ($Fe_2O_3$) and the balance quartz sand and unavoidable impurities.

According to a feature of the invention, the iron oxide which is used has a high purety, i.e. consists of at least 98% $Fe_2O_3$, and is present in a particle size range of 1 to 40 microns.

Best results are obtained with an iron oxide particle distribution or granulometry of 1.0–4.0 μm ca. 50%
4.1–12.0 μm ca. 25%
12.1–35.0 μm ca. 25%.

The chromium ore component preferably comprises 40 to 48% $Cr_2O_3$ and is of a particle size range up to 1 mm. Preferably the particle size distribution or granulometry is:

0.5 mm ca. 15.0%

0.3 mm ca. 43.0%
0.2 mm ca. 25.0%
0.1 mm ca. 15.0%
<0.1 mm ca. 1.5%.

The quartz sand component is also preferably highly pure and should consist of at least 98% $SiO_2$ and should be of a particle size range of 0.1 to 1.0 mm with the preferred particle size distribution or granulometry being:

1.0 mm ca. 0%
0.5 mm ca. 0.1%
0.3 mm ca. 13.3%
0.2 mm ca. 55.0%
0.1 mm ca. 31.0%
<0.1 mm ca. 0.1%.

In the two latter particle-size distributions, the values given in fractions of a mm are the values of the sieve size upon which the indicated proportion of the particles are retained.

In both cases the balance may be dust which is not measured.

Since the spout-filling mass of the invention does not contain any carbon component, it is indeed surprising that cap formation occurs and, of course, there is no danger of carburization of the melt or diffusion of hydrogen from the mass into the melt.

Apparently the iron oxide ensures the cap formation and naturally the proportion of iron oxide used will depend upon the ladle and melt which is contained in the ladle so that the formation of the cap is ensured.

Apparently the iron oxide acts as a melting point lowering initiator or seed of a highly localized effect at the interface so that a glass phase is formed at the interface below and adjoining which the sintering occurs to form a ferrostatical pressure supporting a cap through which the melt can penetrate as long as the particulate mass below it is supported by the closed slider. Indeed, the finely divided character of the iron oxide is important to this effect. The upper layer of the cap may be low-melting fayalite. The rapidly forming fayalite slag of the upper layer accelerates melting of quartz sand adjacent it to promote the sintering effect in defining the cap with the balance of the mass being flowable therebelow.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLE

Figure 1:
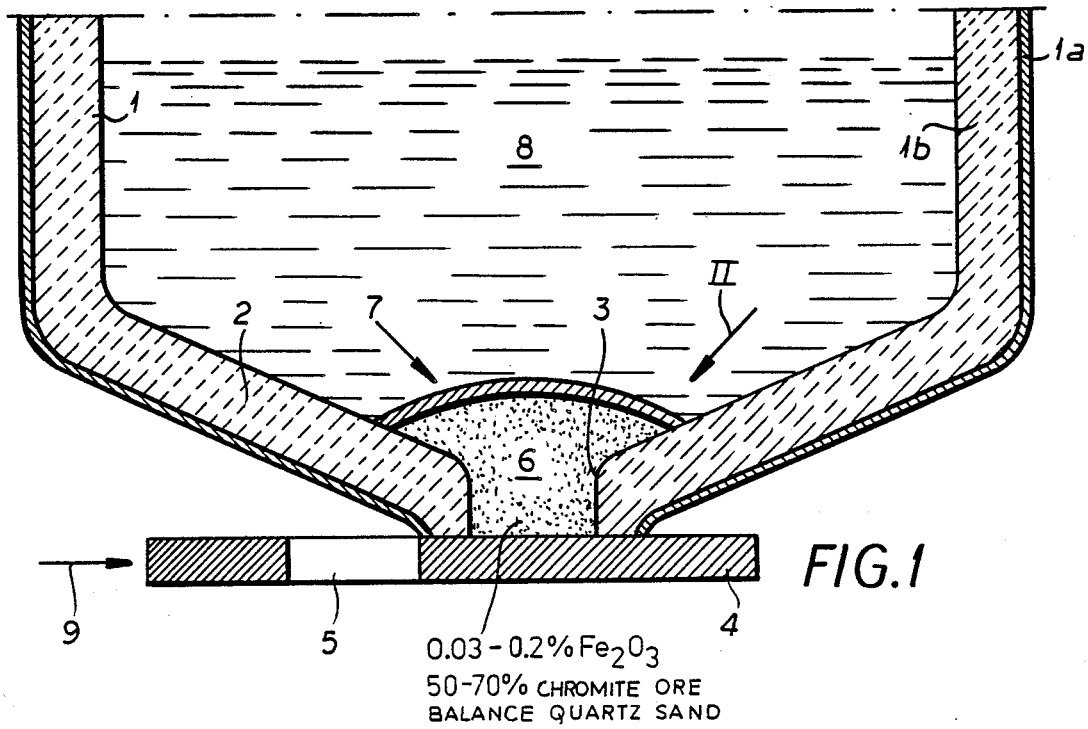
FIG. 1 is a diagrammatic section through the lower portion of a casting ladle emboding the invention.

The casting ladle shown in FIG. 1 comprises, in the usual manner, an outer steel casing 1*a* and an inner lining of refractory material. The ladle 1 defines along the downwardly sloping ladle bottom 2, a discharge spout, passage or sleeve 3.

Below this discharge spout, there is provided a linearly or rotatably shiftable slider 4 having a component 5 which can be aligned with the passage 3 upon movement of the slider in the direction of the arrow 9.

With the slider in the closed position, the flowable filling mass 6 is poured into the spout so that it rests around the slider 4 and forms a heap above the spout 3 overhanging the sides of the bottom 2 around the spout (see FIG. 1).

The result is a mass 7 which comes into contact with the molten steel 8, the latter being introduced into the ladle in a stream impinging on the bottom 2 adjacent the heap.

As a result of the interaction previously described, a thin shell or cap 10 forms between the remainder of the flowable mass and the melt, this shell consisting of a thin glassy layer 10*a* underlain by a thicker sintered layer 1O*b*.

Figure 2:
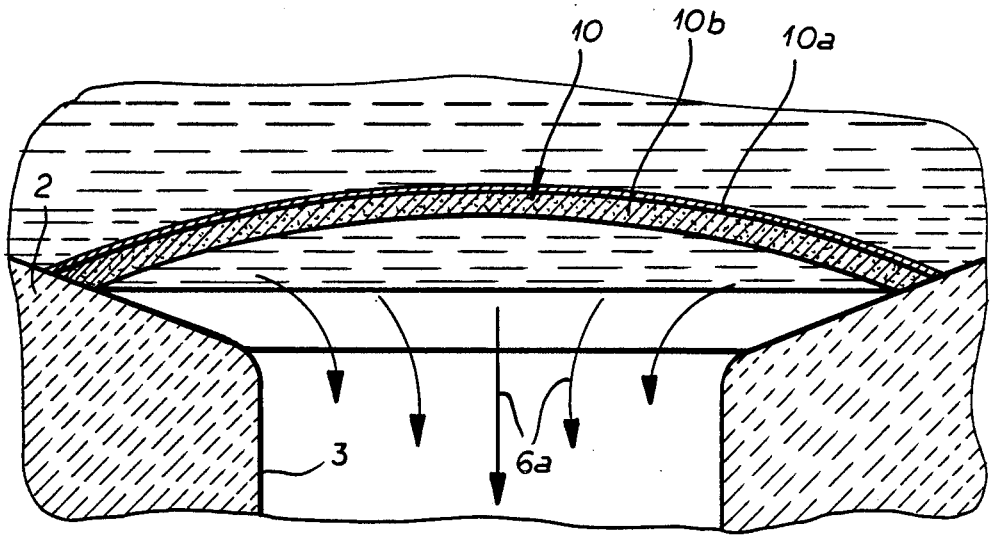
FIG. 2 is a detail view of the region II of FIG. 1.

When the slider is opened, i.e. the opening 5 is aligned with the passage 3, the free flowing particulate mass is discharged FIG. 1 is a diagrammatic section through the lower portion of a casting ladle emboding the invention; and FIG. 2 is a detail view of the region II of FIG. 1.

SPECIFIC DESCRIPTION AND EXAMPLE

The casting ladle shown in FIG. 1 comprises, in the usual manner, an outer steel casing 1*a* and an inner lining of refractory material. The ladle 1 defines along the downwardly sloping ladle bottom 2, a discharge spout, passage or sleeve 3.

Below this discharge spout, there is provided a linearly or rotatably shiftable slider 4 having a component 5 which can be aligned with the passage 3 upon movement of the slider in the direction of the arrow 9.

With the slider in the closed position, the flowable filling mass 6 is poured into the spout so that it rests around the slider 4 and forms a heap above the spout 3 overhanging the sides of the bottom 2 around the spout (see FIG. 1).

The result is a mass 7 which comes into contact with the molten steel 8, the latter being introduced into the ladle in a stream impinging on the bottom 2 adjacent the heap.

As a result of the interaction previously described, a thin shell or cap 10 forms between the remainder of the flowable mass and the melt, this shell consisting of a thin glassy layer 10*a* underlain by a thicker sintered layer 1O*b*.

When the slider is opened, i.e. the opening 5 is aligned with the passage 3, the free flowing particulate mass is discharged and, as the shell is no longer supported, it collapses under the ferrostatic pressure as is represented by the arrows 6*a* to allow discharge of the melt. The mass 6 consists of 50 to 70% chromite ore, 0.03 to 0.2 weight percent $Fe_2O_3$ and the balance quartz sand in the particle size ranges previously described.

SPECIFIC EXAMPLES

A steel melt at a temperature of 1100° C. in a ladle is subjected to vacuum casting employing the stream degassing technique. The steel had the following composition:

0.83% carbon,
0.77% manganese,
0.014% phosphorus,
0.024% sulfur,
0.18% silicon,
2.08% nickel,
0.15% chromium,
balance iron.

The spout-filling mass had substantially the following composition:

60% by weight chromite ore containing 45% $Cr_2O_3$ and a granulometry of 0.5 mm ca. 15.0%
0.3 mm ca. 43.0%
0.2 mm ca. 25.0%
0.1 mm ca. 15.0%
<0.1 mm ca. 1.5%.
balance dust.

0.1% by weight of the mass consisted of iron oxide of 99.5% $Fe_2O_3$ with the following particle size range
1.0–4.0 μm ca. 50%
4.1–12.0 μm ca. 25%
12.1–35.0 μm ca. 25%.

The balance, 39.9% consisted of quartz sand (99.5% $SiO_2$) with the granulometry:
1.0 mm ca. 0%
0.5 mm ca. 0.1%
0.3 mm ca. 13.3%
0.2 mm ca. 55.0%
0.1 mm ca. 31.0%
<0.1 mm ca. 0.1%,
balance dust.

This composition was thoroughly mixed and used as the spout-filling mass for the above-mentioned melt, forming an effective cap which broke away when the flowable mass was released. No carburization of the melt or hydrogen diffusion resulting from the mass was detected.

We claim:

1. A method for controlling the discharge of a steel melt from a casting ladle comprising filling the pouring spout of said ladle with a particulate filling mass consisting essentially of 50 to 70% by weight of chromium ore sand, 0.03 to 0.2% by weight iron oxide and the balance quartz sand intimately mixed together, forming a cap at an interface of said mass and said melt to support said melt in said spout, moving a slider to cover a mouth of said spout into an open position for discharging said melt, and rupturing said cap by discharge of said mass from below said melt.

2. The method defined in claim 1 wherein said iron oxide consists at least 98% by weight of $Fe_2O_3$ and has a particle size range of 1 to 40 microns.

3. The method defined in claim 2 wherein said iron oxide has the following granulometry:
1.0 to 4.0 microns, about 50%,
4.1 to 12.0 microns, about 25%, and
12.1 to 35.0 microns, about 25%.

4. The method defined in claim 2 wherein said chromium ore sand has the following granulometry:
0.5 mm, about 15.0%,
0.3 mm, about 43.0%,
0.2 mm, about 25.0%,
0.1 mm, about 15.0%, and
<0.1 mm, about 1.5%.

5. The method defined in claim 2 wherein said quartz sand consists of at least 98% $SiO_2$ and has a particle size range of 0.1 to 1.0 mm.

6. The method defined in claim 5 wherein said quartz sand has the following granulometry:
1.0 mm, about 0%,
0.5 mm, about 0.1%,
0.3 mm, about 13.3%,
0.2 mm, about 55.0%,
0.1 mm, about 31.0% and
<0.1 mm, about 0.1%.

* * * * *